US008578927B2

(12) United States Patent
Gustavsen

(10) Patent No.: US 8,578,927 B2
(45) Date of Patent: Nov. 12, 2013

(54) HIGH TEMPERATURE BAKE OVEN AND METHOD

(76) Inventor: Willard Gustavsen, Berrien Springs, MI (US)

( * ) Notice: Subject to any disclaimer, the term of this patent is extended or adjusted under 35 U.S.C. 154(b) by 357 days.

(21) Appl. No.: 12/712,575

(22) Filed: Feb. 25, 2010

(65) Prior Publication Data

US 2010/0147281 A1 Jun. 17, 2010

Related U.S. Application Data

(63) Continuation-in-part of application No. 12/044,066, filed on Mar. 7, 2008, now Pat. No. 7,686,010.

(60) Provisional application No. 60/993,394, filed on Sep. 12, 2007.

(51) Int. Cl.
*F24C 15/24* (2006.01)

(52) U.S. Cl.
USPC ..... 126/273.5; 126/19 R; 126/1 R; 126/25 R; 126/27; 126/275 R

(58) Field of Classification Search
USPC ..... 126/1 R, 25 R, 27, 273.5, 274, 275, 126/275 R; 99/447, 481
See application file for complete search history.

(56) References Cited

U.S. PATENT DOCUMENTS

| | | | | |
|---|---|---|---|---|
| 641,575 | A | | 1/1900 | Boud |
| 898,527 | A | | 9/1908 | Thoits et al. |
| 13,110 | A | | 5/1910 | Thoits et al. |
| 1,049,633 | A | | 1/1913 | Whitmer |
| 1,072,231 | A | | 9/1913 | Howell |
| 1,404,808 | A | | 1/1922 | Taylor |
| 2,019,604 | A | | 11/1935 | Grieve |
| 2,095,654 | A | | 10/1937 | Thoreson |
| 3,095,186 | A | * | 6/1963 | Sondy ..... 432/32 |
| 3,313,917 | A | | 4/1967 | Ditzler et al. |
| 3,952,721 | A | | 4/1976 | Patterson |
| 4,126,778 | A | * | 11/1978 | Cole ..... 219/454.11 |
| 4,437,396 | A | * | 3/1984 | Plattner et al. ..... 99/475 |
| 4,455,319 | A | | 6/1984 | Clark |
| 4,498,376 | A | | 2/1985 | Carey |
| 4,800,865 | A | | 1/1989 | Setzer |
| 4,805,588 | A | * | 2/1989 | Reynolds ..... 126/51 |
| 4,889,103 | A | | 12/1989 | Fraioli |
| 5,039,535 | A | | 8/1991 | Lang et al. |
| 5,413,033 | A | | 5/1995 | Riccio |

(Continued)

FOREIGN PATENT DOCUMENTS

| | | | | |
|---|---|---|---|---|
| BE | 893177 | A | * | 8/1982 |
| FR | 2670870 | A1 | * | 6/1992 |
| JP | 2006296237 | A | * | 11/2006 |

*Primary Examiner* — Kenneth Rinehart
*Assistant Examiner* — Jorge Pereiro
(74) *Attorney, Agent, or Firm* — Warner Norcross & Judd LLP

(57) ABSTRACT

A method of baking bread in a high temperature bake oven, comprising initiating a heating element in a lower portion of the bake oven, locating the bread on a first pizza stone located above the heating element, directing circulating heated air in the oven with a baffle around the first pizza stone to between the first pizza stone and a second pizza stone located above the first pizza stone, and directing the circulating heated air in the oven rapidly from between the first and second pizza stones out of the oven through an opening in the front of the oven.

6 Claims, 5 Drawing Sheets

(56) References Cited

U.S. PATENT DOCUMENTS

| | | | | |
|---|---|---|---|---|
| 5,532,456 | A | 7/1996 | Smith et al. | |
| 5,586,488 | A | 12/1996 | Liu | |
| 5,883,362 | A | 3/1999 | Pettibone et al. | |
| 5,954,980 | A | 9/1999 | Westerberg et al. | |
| 6,011,242 | A | 1/2000 | Westerberg | |
| 6,041,769 | A | 3/2000 | Llodra et al. | |
| 6,053,094 | A * | 4/2000 | Cados | 99/331 |
| RE36,724 | E | 6/2000 | Westerberg et al. | |
| 6,070,572 | A | 6/2000 | Casagrande | |
| 6,125,740 | A | 10/2000 | Hedrington et al. | |
| 6,187,359 | B1 | 2/2001 | Zuccarini | |
| 6,262,396 | B1 | 7/2001 | Witt et al. | |
| 6,354,194 | B1 | 3/2002 | Hedrington et al. | |
| 6,384,381 | B2 | 5/2002 | Witt et al. | |
| 6,640,695 | B2 | 11/2003 | Stark | |
| 6,967,036 | B1 | 11/2005 | Hedrington et al. | |
| 7,323,663 | B2 * | 1/2008 | Cavada et al. | 219/411 |
| 7,619,186 | B2 * | 11/2009 | Cavada et al. | 219/506 |
| 2002/0017290 | A1 | 2/2002 | Hines, Jr. | |
| 2002/0060215 | A1 | 5/2002 | Allera et al. | |
| 2002/0069764 | A1 | 6/2002 | Cohen | |
| 2003/0145740 | A1 | 8/2003 | Stark | |
| 2005/0034716 | A1 | 2/2005 | Harbin | |
| 2005/0039612 | A1 | 2/2005 | Denny | |
| 2005/0173400 | A1 * | 8/2005 | Cavada et al. | 219/411 |
| 2006/0102167 | A1 | 5/2006 | Driscoll, Jr. | |
| 2006/0191528 | A1 | 8/2006 | Spangrud | |

* cited by examiner

HIGH TEMPERATURE BAKE OVEN AND METHOD

RELATED APPLICATIONS

This application is a continuation in part application of U.S. Ser. No. 12/044,066 filed Mar. 7, 2008, which application claims priority to U.S. Provisional Patent Application Ser. No. 60/993,394 filed Sep. 12, 2007.

FIELD OF THE INVENTION

This invention relates to a high temperature bake oven and method, particularly, but not exclusively, useful for baking pizza to temperatures ranging from 600 to 1000° F. which may be used for baking pizza on a conventional gas, wood or briquette outdoor grill.

BACKGROUND OF THE INVENTION

The history of pizza began hundreds of years ago with the addition of toppings on flat bread, such as the Greek "Pita," "Pide" in Turkey, "Naan" or "Paratha" in India and "Flammkuchen" in Germany. The first reference to "Pizza" is by the Italian Renaissance Chef Scappi published in 1570. However, the now preferred Neapolitan-style pizza requires baking at a temperature of between about 600 and 1000° F. The majority of pizza ovens are commercial brick ovens which are very large, expensive and require preheating generally for several hours. There are also dome-shaped pizza ovens which may be gas or coal fired which are also large and expensive. Finally, there are now commercial electric pizza ovens which typically do not heat the pizza to greater than 500° F. However, there are now also consumer pizza ovens which typically do not heat the pizza to greater than 450° F. and are also relatively expensive. At present, however, there are no relatively inexpensive consumer pizza ovens or methods of baking pizza which heat the pizza to 600° to 1000° F. or greater and which may be utilized as an insert for a conventional backyard-type grill. Typical commercial pizza ovens cost of tens of thousands of dollars.

SUMMARY OF THE INVENTION

The high temperature bake oven and method of this invention may be utilized to bake authentic hearth baked Neapolitan-style pizza at temperatures ranging from 600 to 1000° F. and is thus comparable to a large, expensive brick pizza ovens. However, the high temperature bake oven and method of this invention may also be used, for example, to bake flat bread including, for example, Greek "Pita," Turkish "Pide" flat bread or Indian "Naan" bread. The high temperature bake oven and method of this invention may also be used as an insert for a conventional coal, wood or gas briquette fired backyard grill which heats the internal bake oven chamber to a temperature of between 600 and 1000° F. in a relatively short time and is relatively inexpensive, particularly compared to commercial pizza ovens. Although the high temperature bake oven of this invention may be utilized as an insert for a backyard-type grill, the high temperature bake oven of this invention may also be a stand alone bake oven having its own source of heat, such as a gas fired flame.

The high temperature bake oven and method of this invention includes an oven having a source of convection heat which may also be a source of radiant heat including, for example, a gas fired flame or burning wood, briquettes or coal. The high temperature bake oven further includes a first stone-like or pizza stone plate located above the source of heat for receiving an item to be baked, such as a pizza or flat bread. As used herein, the term "pizza stone" is available from several commercial sources and available online, which typically is formed of a Mullite-based ceramic refractory material or natural stone capable of withstanding temperatures in excess of 1000° F., such as "Cordierite" and "FibraMent" or other stone or stone-like materials capable of withstanding the extreme heat of the high temperature bake oven of this invention. The high temperature bake oven and method of this invention further includes a second pizza stone located above the first pizza stone which, in the disclosed embodiment, is generally parallel to the first pizza stone. The high temperature bake oven of this invention further includes a housing enclosing the second pizza plate and defining a bake oven chamber between the first and second pizza stones having a front opening directing convection heat upwardly from the source of heat toward the second pizza stone and between the first and second pizza stones over an item to be baked on the first pizza stone and through the front opening of the housing. The high temperature bake oven of this invention creates a draft and thus circulates heated air from the source of heat through the bake oven chamber having an item to be baked on the first pizza stone and through the front opening, quickly raising the temperature in the bake oven chamber to 600 to 1000° F. suitable for baking true New York or Neapolitan-style pizza. The upper or second pizza stone also radiates heat onto the item being baked on the first pizza stone.

As will be understood from the description of the preferred embodiments of the high temperature bake oven of this invention, the method of rapidly baking bread, including pizza, in a high temperature bake oven of this invention includes initiating or igniting a heating element in a lower portion of a bake oven; locating the bread or pizza to be baked on a first pizza stone located above the heating element in the oven, such that the heating element heats the first pizza stone and the bread typically by convection heat; directing circulated heated air in the oven with a baffle from the heating element around the first pizza stone to between the first pizza stone and the second pizza stone which, as described above, is located above and generally parallel to the first pizza stone, heating the bread on the first pizza stone and the second pizza's stone heating the bread by radiation; and directing the circulating heated air in the oven rapidly from between the first and second pizza stones over the bread and out of the high temperature oven through the opening in front of the oven. In the disposed embodiment of the oven, the baffle is located adjacent to the back wall of the oven enclosure, angled upwardly generally toward the second pizza stone, wherein the method of this invention includes directing heated convection air upwardly around the first pizza stone and between the first and second pizza stones, heating the bread and the second pizza stone. In a disclosed embodiment of the high temperature bake oven of this invention, the end or free end of the baffle is angled downwardly from adjacent the upper pizza stone onto the bread on the first pizza stone and upwardly against the second pizza stone. Further, in another disclosed embodiment of the pizza oven of this invention, the oven includes a deflector adjacent the opening in the front of the oven extending generally downwardly toward the first pizza stone from adjacent the second pizza stone, the method thus includes directing heated convection air from adjacent the second pizza stone, generally downwardly toward the first pizza stone. The baffle and the deflector create more turbulent flow within the oven chamber and retains the heated circulating air longer within the oven enclosure.

As will be understood by those skilled in this art, various modifications may be made to the high temperature bake oven and method of this invention within the purview of the appended claims and the following description of the preferred embodiments is intended for illustrative purposes only and thus do not limit the scope of the invention, except as set forth in the appended claims.

DESCRIPTION OF THE PREFERRED EMBODIMENTS

Figure 1:
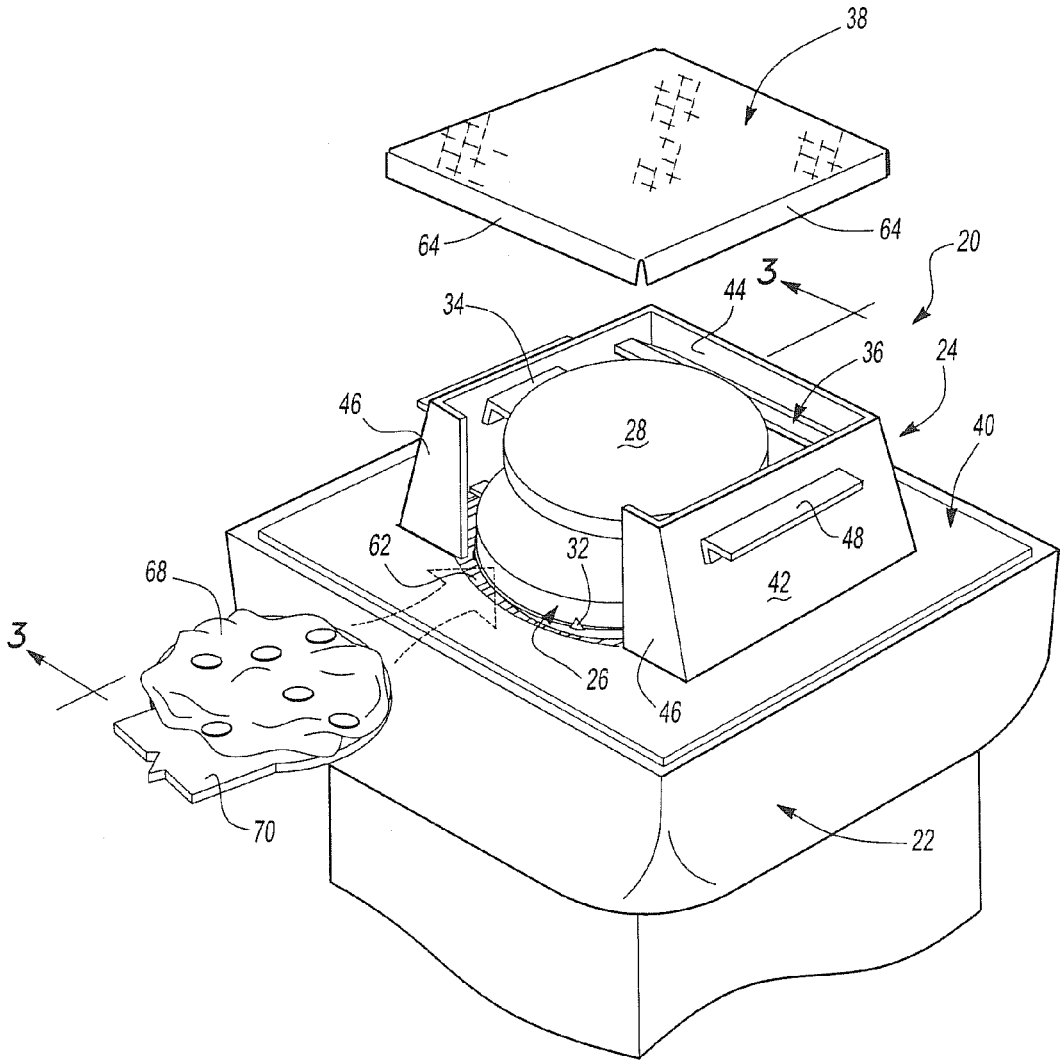
FIG. 1 is a perspective view of one embodiment of the high temperature bake oven of this invention with the cover raised.
Figure 2:
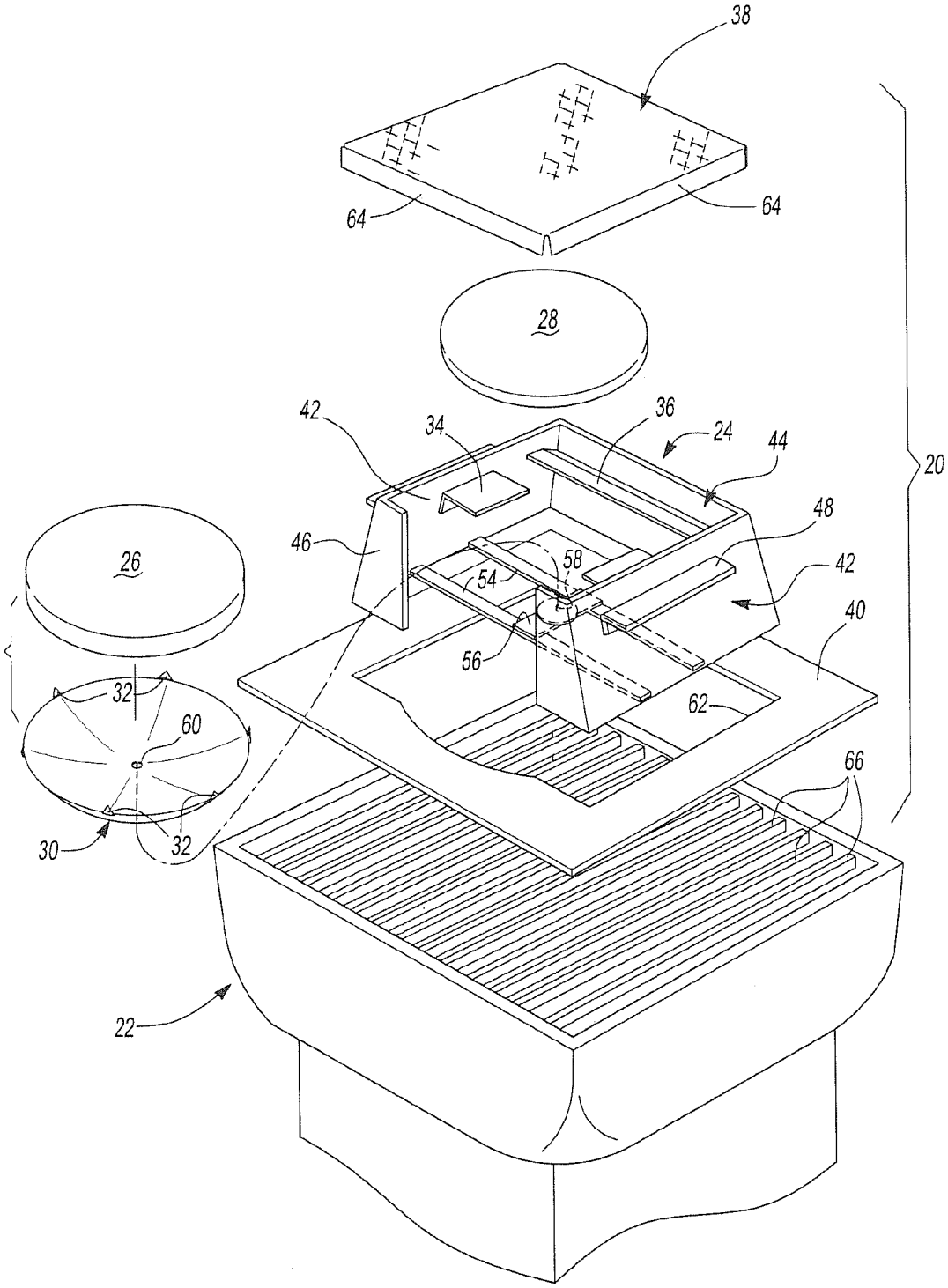
FIG. 2 is an exploded perspective view of the high temperature bake oven shown in FIG. 1.

The disclosed embodiment of the high temperature bake oven 20 shown in FIGS. 1 to 4 of this invention may be utilized in the method of the invention to bake flat bread, but is particularly useful for baking authentic hearth baked New York or Neapolitan-style pizza which requires a baking temperature of between about 600 and 1000° F. The high temperature bake oven 20 of this invention may be utilized with a conventional backyard-type grill, such as the grill shown at 22, or the high temperature bake oven of this invention may include its own source of convection heat (not shown) including, for example, a gas fired flame or burning wood, coal or briquettes. The components of the disclosed embodiment of the high temperature bake oven 20 are best shown in FIG. 2, which in the disclosed embodiment include a housing or frame assembly 24, a first pizza stone 26, a second pizza stone 28 supported in spaced parallel relation above the first pizza stone 26, a turntable 30 for the first pizza stone 26 which in the disclosed embodiment, is a hemispherical or bowl-shaped metal member which includes a plurality of circumferentially spaced upstanding tangs or tabs 32 which surround and retain the first pizza stone 26. As will be understood by those skilled in the art, the temperature of the bake oven chamber between the first and second pizza stones 26 and 28 will be greater near the back and thus it will be advantageous to rotate the first pizza stone 26 during baking to prevent burning of the item on the first pizza stone. The second pizza stone 28 is supported on a deflector or baffle 36 and flanges 34 attached to the side walls of the housing 24. The disclosed embodiment of the high temperature bake oven further includes a cover 38 enclosing the top of the housing 24 and forming a bake oven chamber, and a baffle 40 directing heated air from the grill 22 into the high temperature bake oven 20 as described below.

Figure 3:
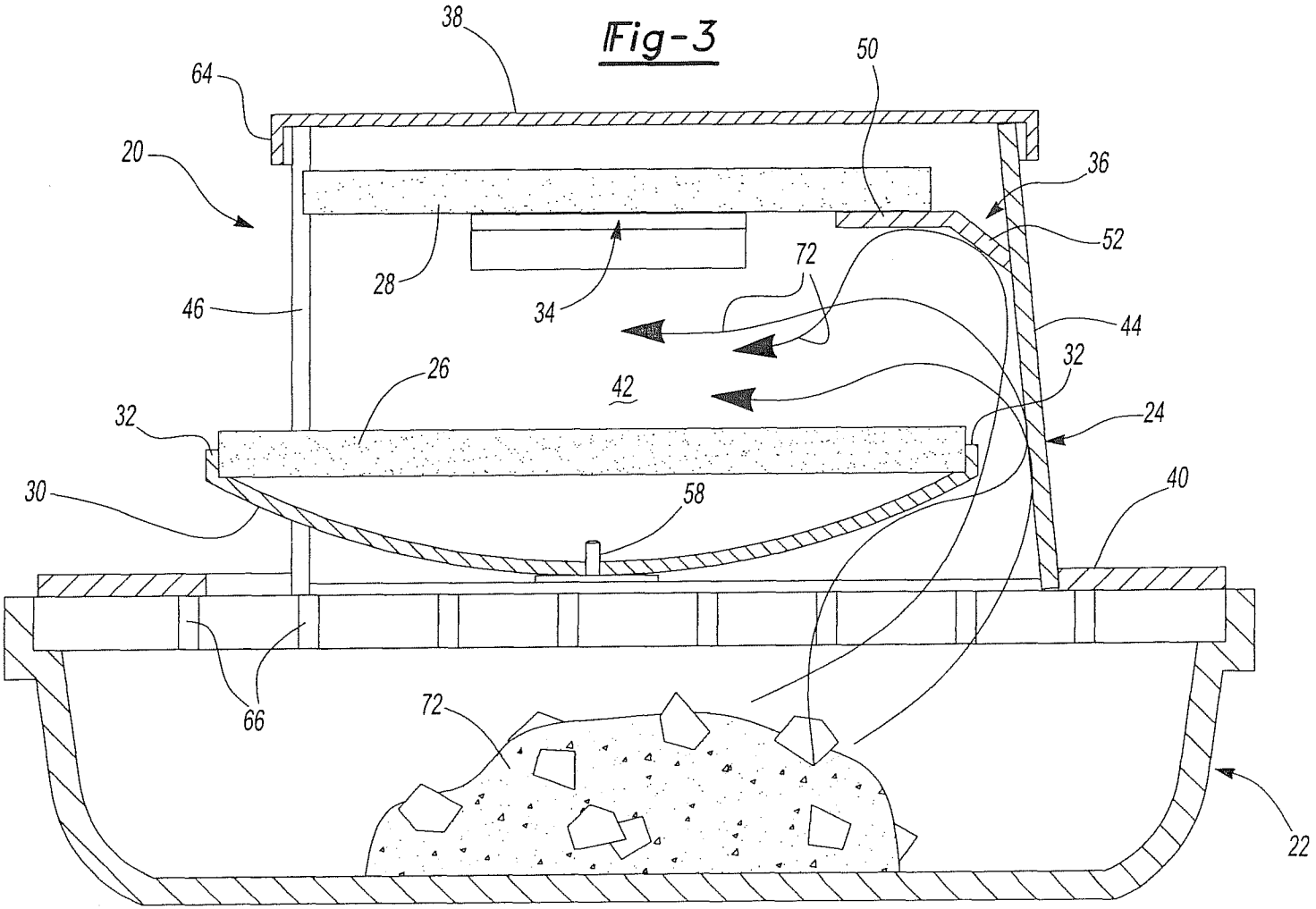
FIG. 3 is a side cross-sectional view of the high temperature bake oven shown in FIGS. 1 and 2.

The housing 24 includes side housing members 42, which are inclined inwardly to direct circulating heated air to the upper or second pizza stone 28, a back or rear housing member 44, which is also inclined upwardly as shown in FIG. 3 to direct heated air inwardly toward the second pizza stone 26, and front side members 46 which are generally triangular in shape, but truncated as shown in FIG. 2. Thus, the housing 24, including the cover 38, encloses the first and second pizza stones 26 and 28 forming a bake oven chamber between the first and second pizza stones 26 and 28, respectively, with a front opening between the front side members 46, creating a high temperature draft through the bake oven chamber and heating an item on the first pizza stone 26 to very high temperatures, as described herein. As shown in FIGS. 1 and 3, the front opening of the housing 24 between the front side members 46 has a height generally equal to the distance between the first and second pizza stones 26 and 28 and is aligned with the space between the first and second pizza stones 26 and 28.

In the disclosed embodiment of FIGS. 1 to 4, the side housing members 42 includes optional handles 48 for lifting the high temperature bake oven 20 off of the grill 22. The deflector 36 includes a horizontal portion 50, which may be used to support the second pizza stone 28 as shown in FIG. 3, and a deflector portion 52 which is angled upwardly from the back housing member 44 as also shown in FIG. 3. As shown in FIG. 2, the housing 24 includes lower parallel cross-members 54, and a central transverse member 56 which support a pivot rod assembly 58. The pivot rod 58 is received in a hole 60 in the bowl-shaped turntable 30 as shown in FIGS. 2 and 3, permitting the first pizza stone 26 to be easily rotated as described below. The baffle 40 partially covers the opening in the grill 22 and the baffle includes an opening 62 configured to receive the housing 24 and the lower or first pizza stone 26 as further disclosed below. In the disclosed embodiment, the cover 38 includes flanges 64 which receive the walls of the housing 24 as shown. Further, in the disclosed embodiment, the grill 22 includes transverse grates 66 which support the high temperature bake oven 20.

Figure 4:
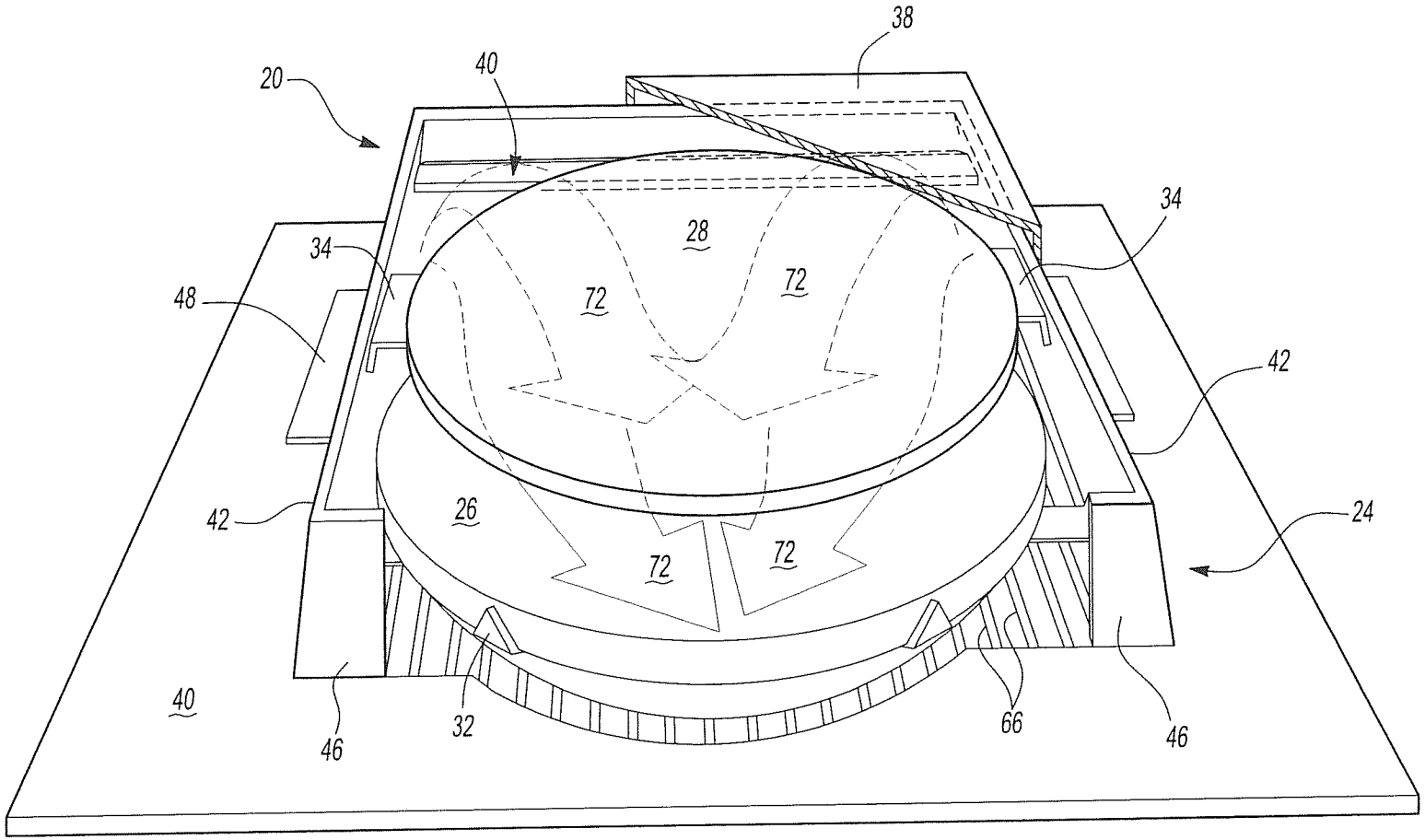
FIG. 4 is a partial front perspective view of the high temperature bake oven shown in FIGS. 1 to 3 with the cover partially removed and cross-sectioned.

As shown in FIG. 1, the item to be baked, such as the pizza 68, is received through the front opening of the high temperature bake oven 20 between the front side members 46 of the oven. In the disclosed embodiment, the pizza 68 is received on a slide 70 and disposed through the front opening onto the first pizza stone 26 and the front opening remains open during baking providing a view of the pizza 68 during baking. FIG. 1 also illustrates the relative orientation of the first and second pizza stones 26 and 28 upon receipt of the item to be baked, such as the pizza 68, wherein the first and second pizza stones 26 and 28 are in parallel relation and relatively closely spaced. FIGS. 3 and 4 illustrate the draft circulation of heated air through the bake oven chamber formed by the housing 24 including the cover 38. As best shown in FIG. 3, the grill includes a source of heat, such as a burning charcoal 72. The heated air rises by convection and, because the lower or first pizza stone 26 is spaced from the back housing member 44, the heated air is primarily directed upwardly by the deflector 52 between the back housing member 44 and the first pizza stone 26 as shown by arrows 72. As will be understood, however, because the first pizza stone 26 is circular and the housing 24 is rectangular, heated air will also be drawn upwardly around the first pizza stone 24. The draft of hot air as shown by arrows 72 in FIGS. 3 and 4, heats the first and second pizza stones 24 and 26, respectively, by convection. However, the heated first and second pizza stones then radiate heat to an item to be baked on the first pizza stone 24, such as the pizza 68 shown in FIG. 1. Thus, the design of the housing 24 promotes the rapid draft circulation of heated air as shown by arrows 72. Further, the hemispherical or bowl-shaped turntable 30 directs the circulation of heat outwardly, further promoting the draft circulation of the heated air. The circulation of the heated air is also promoted by the inwardly inclined side and back walls 42 and 44, respectively, and the baffle portion 52 of the baffle 36 as shown in FIG. 3. In the disclosed embodiment, the first pizza stone 26 has a diameter greater than the diameter of the second or upper pizza stone 28 and the first pizza stone 26 is set forwardly as shown in FIG. 3, promoting the draft circulation of heated air into the bake oven chamber from between the first pizza stone 26 and the rear housing member 44.

As set forth above, the first and second pizza stones 24 and 26 may be formed of any stone or "stone-like" material including for example Mullite-based refractory ceramic materials, commonly known as "pizza stone" available from several sources on line, including "Cordierite" and "Fibra-Ment." The baffle 40 and housing 24 may be formed of steel and the L-shaped side flanges 34 and deflector 36 may be welded to the side and back housing members 42 and 44, respectively. Similarly, the parallel cross members 54 may be welded to the side housing members 42. In the disclosed embodiment, the tangs or tabs 32 are triangular and may be engaged by any tool to rotate the lower first pizza stone 26, such that the item on the first pizza stone 26 is evenly heated. Alternatively, as set forth below, the turntable may be powered. In the disclosed embodiment, the first and second pizza stones 24 and 26 are parallel and may be spaced two to three inches apart. However, depending upon the diameter of the pizza stones, the pizza stones could be spaced further apart. The bottom or first pizza stone may be positioned approximately one to two inches above the grill surface. The first pizza stone may have a diameter of approximately 16 inches and the upper second pizza stone may have a diameter of about 12 to 13 inches. The space between the back of the first pizza stone 26 may be one to two inches from the back housing member 44 to promote a draft around the rearward portion of the first pizza stone for better draft circulation as described above. The cover 38 may be formed of aluminum because of the high heat conductivity of aluminum which increases the efficiency of the overhead heating of the item to be baked. Alternatively, the second pizza stone 28 may serve as the cover, in which case, the second pizza stone 28 may be rectangular and larger than the first pizza stone 26.

Figure 5:
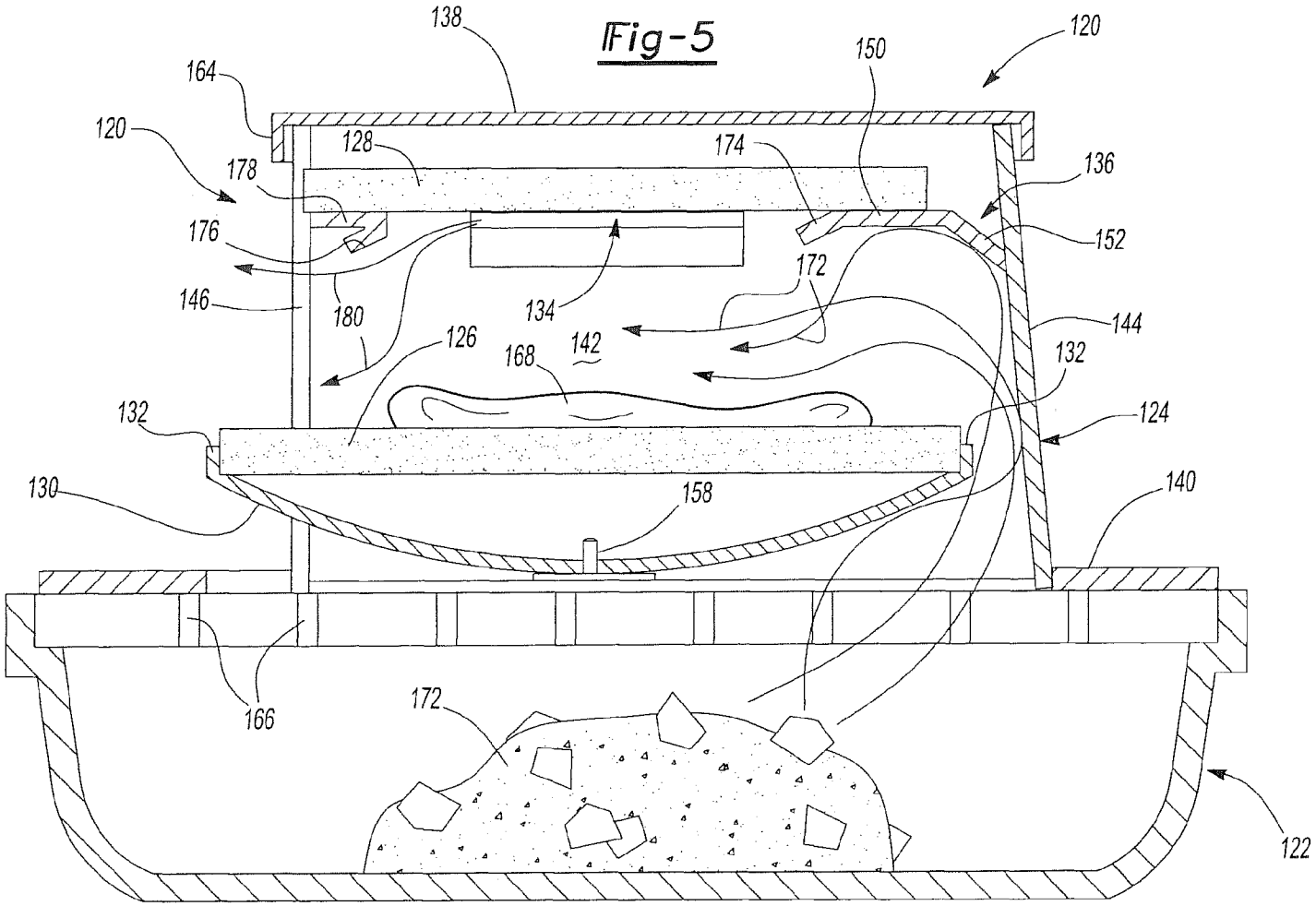
FIG. 5 is a side cross-sectional view of an alternative embodiment of the high temperature bake oven.

The embodiment of the high temperature bake oven shown in FIG. 5 may be very similar to the bake oven disclosed in FIGS. 1 to 4 and the cross-section of FIG. 5 is very similar to the cross-section of FIG. 3. Thus, the high temperature bake oven 120 has been marked with the same reference numbers as the high temperature bake oven 20 shown in FIGS. 1 to 4 except as described below. Thus, the embodiment of the high temperature bake oven 120 shown in FIG. 5 includes an enclosure formed by the walls 144 as described above, an open front end 146, a heating element 172 in the lower portion of the oven enclosure, a first pizza stone 126 located above the heating element, a second pizza stone 128 located above and generally parallel to the first pizza stone 126 and a baffle 150 angled upwardly as shown at 152 generally toward the second pizza stone 128 as described above. Thus, no further description of the components of the high temperature pizza oven 120 shown in FIG. 5 is required for a person of ordinary skill in this art to fully understand the embodiment of the pizza oven 120. However, the differences between the high temperature bake oven 120 shown in FIG. 5 and the high temperature bake oven 20 shown in FIGS. 1 to 4 will now be described.

As shown in FIG. 5, the free end 174 of the baffle 136 is angled generally downwardly generally toward the first pizza plate 126. Thus, as shown by the upper arrow 172, the heated circulating air adjacent the upper or second pizza plate 128 is deflected downwardly by the free end 174 of the baffle 136 onto the pizza 168. Further, the free end 174 of the baffle also creates turbulence within the oven enclosure, retaining the heated convection air within the oven enclosure longer, resulting in an improved baking of the pizza 168. In the embodiment of the high temperature bake oven 120 shown in FIG. 5, a further deflector 176 has been added which is angled downwardly generally toward the first pizza plate 126. In this embodiment, the deflector 176 further includes a portion 178 which is parallel to the second pizza plate 128 which may be used to support the free end of the second pizza plate 128 when attached to the side wall 142, such as by welding. As shown by arrows 180, the heated convection gas moving along the upper or second pizza plate 128 is deflected downwardly by the deflector 176 generally toward the first pizza plate 126, creating further turbulence and retaining the heated convection air in the oven longer, thereby improving the efficiency of the high temperature bake oven 120.

As will be understood from the above-detailed description of the preferred embodiments of the high temperature bake oven, the method of rapidly baking bread, including pizza, in the disclosed embodiment of the high temperature bake oven, the method of rapidly baking bread, including pizza, of this invention includes the following steps:

First, initiating or igniting a heating element 72, 172 in a lower portion of the bake oven; locating the bread or pizza to be baked on a first pizza stone 26, 126 located above the heating element 72, 172, such that the heating element heats the first pizza stone and the bread or pizza 68, 168; directing the circulating heated air in the oven with a baffle 52, 152 around the first pizza stone 26, 126 to between the first and second pizza stones, heating the bread or pizza 68, 168 by convection and radiation; and directing the circulating heated air in the oven rapidly from between the first and second pizza stones 26, 126 and 28, 128 over the bread 68, 168 and out of the high temperature bake oven through an opening 146 in the front of the oven. In the disclosed embodiments of the high temperature bake oven wherein the baffle 36, 136 is located adjacent a back wall 44,144 of the oven enclosure and angled upwardly generally toward the second pizza stone 26, 126 as shown at 152, the method includes directing heated convection air upwardly around the first pizza stone 26, 126 adjacent the back wall 44,144 toward the second pizza stone 28, 128, thereby directing heated convection air between the first and second pizza stones 26, 126 and 28, 128, heating the bread or pizza 168 and the second pizza stone as shown by arrows 72, 172. Where the free end 174 of the baffle is angled downwardly generally toward the first pizza stone 126, the method includes directing the heated convection air adjacent the second pizza stone 128 downwardly onto the brea 168 on the first pizza stone and upwardly against the second pizza stone 128. Where the high temperature bake oven further includes a deflector 176 adjacent the opening 146 in the front of the oven extending generally downwardly toward the first pizza stone 126 from adjacent the second pizza stone 128 as shown in FIG. 5, the method includes directing heated convection air from adjacent the second pizza stone 128 generally downwardly toward the first pizza stone 126 as shown by arrows 180 in FIG. 5.

The disclosed embodiments of high temperature bake oven 20, 120 may be utilized to bake pizza by the method of this1 invention at temperatures ranging from 600 to 1000° F., making authentic hearth baked New York or Neapolitan-style pizza and may be utilized with any conventional grill, such as a conventional backyard grill. However, various modifications may be made to the high temperature bake oven and method of this invention within the purview of the appended claims. For example, the first and second pizza stones may be square or rectangular. However, in the disclosed embodiment, the upper or second pizza stone plate 28, 128 is smaller than the first pizza stone plate 26, 126 and the first pizza stone plate is spaced from the rear wall or rear housing member 44, 144. Further, although the high temperature bake oven of this invention has the advantage that it may be utilized with a conventional outdoor grill, the heat source and the high temperature oven may be combined in a single unit. Finally, the turntable 30, 130 may be connected to a motor, rotating the turntable as is known in the art. Other modifications may also be made within the purview of the appended claims.

What is claimed is:

1. A method of baking bread, including pizza, in a high temperature bake oven, comprising the following steps:

initiating a heating element in a lower portion of the bake oven;

locating the bread to be baked on a first pizza stone located above the heating element in the oven, such that the heating element heats the first pizza stone and the bread;

directing circulating heated air in the oven with a baffle from the heating element around the first pizza stone to between the first pizza stone and a second pizza stone located above and generally parallel to the first pizza stone, heating the bread on the first pizza stone, and the second pizza stone, then directing heated air downwardly with a downwardly angled baffle onto the bread on the first pizza stone heating the bread; and directing the circulating heated air in the oven from between the first and second pizza stones over the bread and out of the high temperature bake oven through an opening between the first and second pizza stones.

2. The method as defined in claim 1, wherein the bracket is located adjacent a back wall of the of the oven enclosure angled upwardly adjacent the back wall of the oven generally toward the second pizza stone thereby directing heated convection air upwardly around the first pizza stone and between the first and second pizza stones heating the bread and the second pizza stone.

3. A method of baking bread, including pizza, comprising the following steps:

initiating a heating element in a lower portion of a bake oven;

locating the bread to be baked on a first pizza stone located above the heating element in the oven, such that the heating element heats the first pizza stone and the bread;

directing circulating heated air in the oven from the heating element around the first pizza stone to between the first pizza stone and a second pizza stone located above and generally parallel to the first pizza stone, heating the bread on the first pizza stone;

then directing the circulating heated air downwardly onto a midportion of the bread;

the circulating heated air then circulating upward toward the second pizza stone;

then directing the circulating heated air downwardly toward the first pizza stone, forming a wave-like circulation of heated air between the first and second pizza stones; and then circulating heated air outwardly out of the oven through an outlet between the first and second pizza stones.

4. The method as defined in claim 3, wherein the method includes directing the heated circulating air out of the oven through an opening in the front of the oven.

5. The method of baking bread as defined in claim 3, wherein the method includes directing the circulating heated air downwardly onto a midportion of the bread with a downwardly angled baffle.

6. The method as defined in claim 5, wherein the method includes directing the heated air downwardly by a second inclined baffle, thereby creating a downward and upward motion of circulating heated air through the upper area of the oven.

* * * * *